US005951139A

United States Patent [19]

Smith et al.

[11] Patent Number: 5,951,139

[45] Date of Patent: Sep. 14, 1999

[54] SURGICAL LIGHT WITH REFLECTOR-LAMPS AND FLAT REFLECTOR PANELS

[75] Inventors: A. Michael Smith, Boulder; Mark P. Jongewaard, Arvada; Henry Holt Frazier, Broomfield, all of Colo.

[73] Assignee: Steris Corporation, Mentor, Ohio

[21] Appl. No.: 08/840,963

[22] Filed: Apr. 17, 1997

[51] Int. Cl.[6] ..... F21V 13/04

[52] U.S. Cl. ..... 362/33; 362/804; 362/238; 362/241; 362/250; 362/399

[58] Field of Search ..... 362/804, 33, 250, 362/252, 293, 301, 300, 287, 238, 241, 399

[56] References Cited

U.S. PATENT DOCUMENTS

| | | | |
|---|---|---|---|
| 4,159,511 | 6/1979 | Dejonc | 362/299 |
| 4,242,727 | 12/1980 | deVos et al. | 362/346 |
| 4,422,134 | 12/1983 | Brass | 362/300 |
| 4,575,788 | 3/1986 | Lewin | 362/346 |
| 4,578,575 | 3/1986 | Roos | 250/203 R |
| 4,617,619 | 10/1986 | Gehly | 362/804 |
| 4,979,086 | 12/1990 | Heinisch | 362/297 |
| 5,199,785 | 4/1993 | Scholz | 362/296 |
| 5,331,530 | 7/1994 | Scholz | 362/293 |
| 5,757,145 | 5/1998 | Johnson | 315/308 |
| 5,765,943 | 6/1998 | Verdier | 362/804 |
| 5,800,051 | 9/1998 | Gampe | 362/804 |

FOREIGN PATENT DOCUMENTS

| | | |
|---|---|---|
| 512192 | of 0000 | France . |
| 825638 | of 0000 | United Kingdom . |

*Primary Examiner*—Sandra O'Shea
*Assistant Examiner*—Marshall Honeyman
*Attorney, Agent, or Firm*—Fay, Sharpe, Beall, Fagan, Minnich & McKee LLP

[57] ABSTRACT

A frame (10) supports a plurality of illumination modules (12) arranged in a common plane in a spoke-like pattern extending radially outward from a central axis. Each module includes a lamp (24) with a vertical filament (26) mounted in a faceted reflector (22) to direct a beam of light to a planar, dichroic mirror (30). The mirror (30) reflects the visible spectrum portion of the beam of light downward toward the central axis with all of the beams of light intersecting the central axis in a common plane to create an illumination zone of selected diameter. A disk (32) which is light transmissive at least in portions (34) forms a bottom cover for a cover (14). A handle (40) is rotatably mounted to the frame and connected by a mechanical linkage (50) with the reflectors for tipping the angle of the emitted light beams to adjust the diameter of the illumination zone.

22 Claims, 2 Drawing Sheets

SURGICAL LIGHT WITH REFLECTOR-LAMPS AND FLAT REFLECTOR PANELS

BACKGROUND OF THE INVENTION

The present invention relates to the lighting arts. It finds particular application in conjunction with surgical lights and will be described with particular reference thereto. It is to be appreciated, however, that the present invention may also find application in conjunction with lights and illumination sources for other purposes.

Typically, surgical lamps are relatively large in diameter and are suspended by a series of articulated arms. A domed reflector is disposed inside of the light head with a single lamp disposed in such a position that the light reflected by the reflector forms a defined column. Typically, the lamp is disposed at or near the focal point of the reflector. One of the drawbacks of such single reflector systems is that their large precision reflectors are relatively expensive. Another drawback is that the depth or height of the large diameter reflector limits the thinness of the light head.

Normally, an adjustment is provided, such as with a rotatable handle at the center of the face of the light head, to adjust the diameter of the light spot. It is important for the light spot, when focused on a planar surface, to have a consistent uniform intensity at all diameters. Moreover, during a surgical procedure, the surgeon's hands and head often are positioned between the light head and the illuminated surgical zone. Sufficient light must be provided by the rest of the light head not obscured by the surgeon that significant shadows are not cast into the surgical zone. Often, refractors are provided to cause light rays to traverse a multiplicity of paths to improve uniformity and reduce shadows. Although effective, refractors again tend to be expensive, particularly in large diameters.

It is important that illumination is not lost during a surgical procedure, even if the bulb should burn out. To this end, a backup bulb is typically provided. In some light heads, the backup light bulb is near the primary lamp. However, because is it not at the proper position relative to the reflector, the performance of the light head is adversely affected. Some light heads use a mechanical mechanism to swap the positions of the primary and backup lamps. Although satisfactory, mechanisms for changing the position of the bulbs have drawbacks. First, the mechanisms add cost. Second, the mechanisms tend to be bulky and contribute to the thickness of the light head.

The present invention contemplates a new and improved technique for overcoming the above-referenced drawbacks and others.

SUMMARY OF THE INVENTION

In accordance with one aspect of the present invention, a surgical light is provided. A cover is mounted to a frame which supports a plurality of independent light modules.

In accordance with a more limited aspect of the present invention, each of the modules is mounted radially in a wagon-wheel like pattern with light being discharged adjacent a periphery.

In accordance with another more limited aspect of the invention, each of the modules include a reflector and a lamp which are mounted to direct a beam of light toward a dichroic mirror disposed adjacent a periphery of the frame. The dichroic mirror reflects visible spectrum components of the beams toward a common illumination zone.

In accordance with another more limited aspect of the present invention, the reflector is fluted and faceted.

In accordance with another more limited aspect of the present invention, the lamp has a filament mounted parallel to the beam of light projected from the reflector.

In accordance with another aspect of the present invention, a surgical light is provided. A lamp is mounted in a reflector such that when the lamp is illuminated, the lamp and reflector project a beam of light. The lamp includes a filament mounted parallel to the projected beam of light. The beam of light carries an image of the filament viewed in the direction of the beam of light. In this manner, orienting the filament parallel to the beam of light increases the axial symmetry of the beam of light.

In accordance with a more limited aspect of the invention, the reflector is faceted.

In accordance with another aspect of the present invention, a method of illuminating a surgical site is provided. A plurality of lighting modules are mounted radially outward from a common axis. Within each module, a lamp is illuminated to generate light. The light is reflected from a reflector to create a beam of light directed radially outward from the central axis. The beams of light are deflected generally parallel to the common axis but towards the common axis such that the plurality of the beams of light all cross the common axis adjacent a common plane to define an illumination zone.

In accordance with a more limited aspect of the present invention, the reflecting step reflects only a visible spectrum toward the illumination zone and diverts infrared light from reaching the illumination zone.

One advantage of the present invention resides in reduced cost.

Another advantage of the present invention is that it reduces shadowing.

Another advantage of the present invention is that it increases the depth of field of the projected light beam.

Another advantage of the present invention resides in its improved reliability and assured continuation of illumination in the event of bulb burnout.

Further advantages include its slim profile and its modularity.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
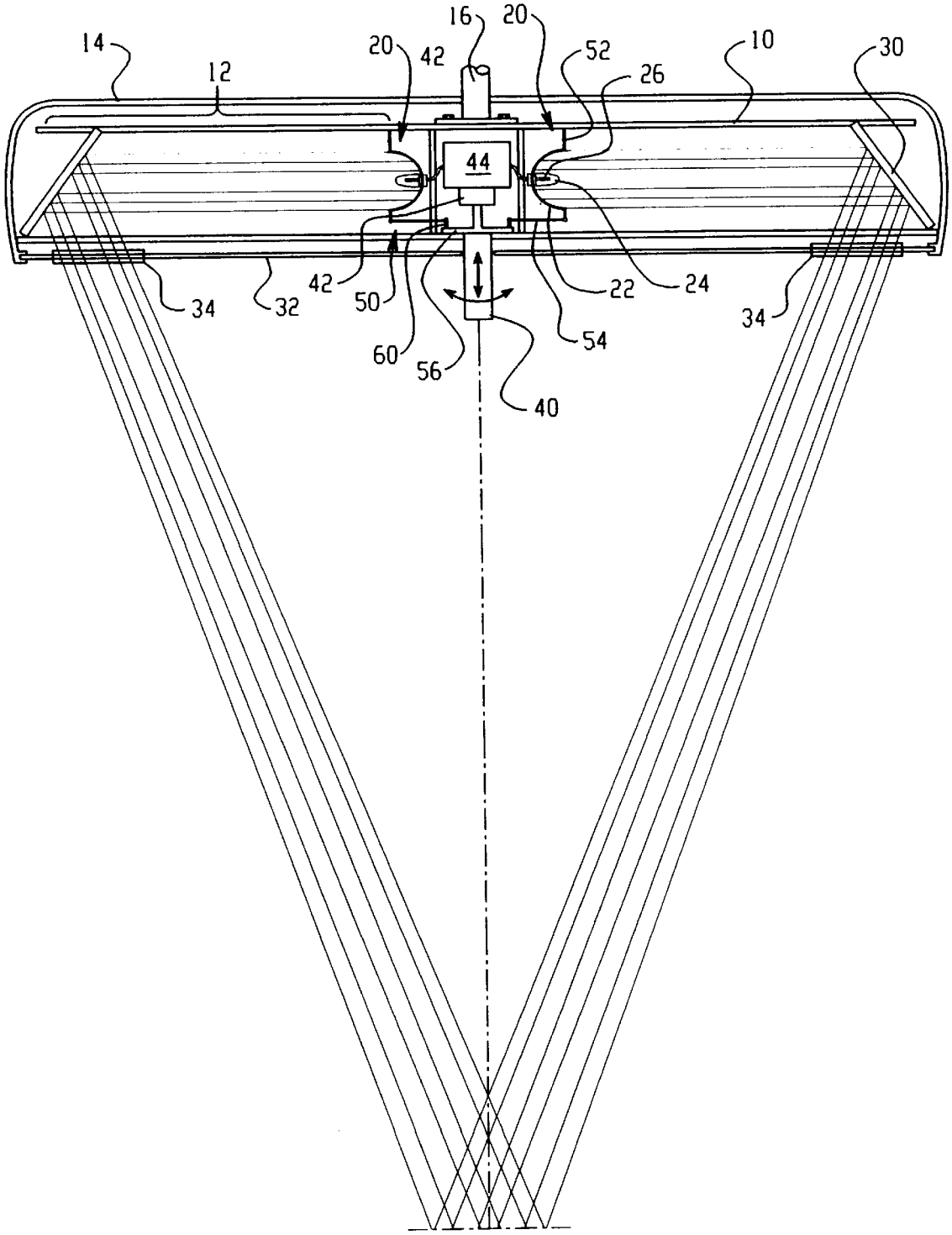
FIG. 1 is a side sectional view of a surgical light in accordance with the present invention; and, FIG. 2 is a top view in partial section of the surgical light of FIG. 1.
Figure 2:
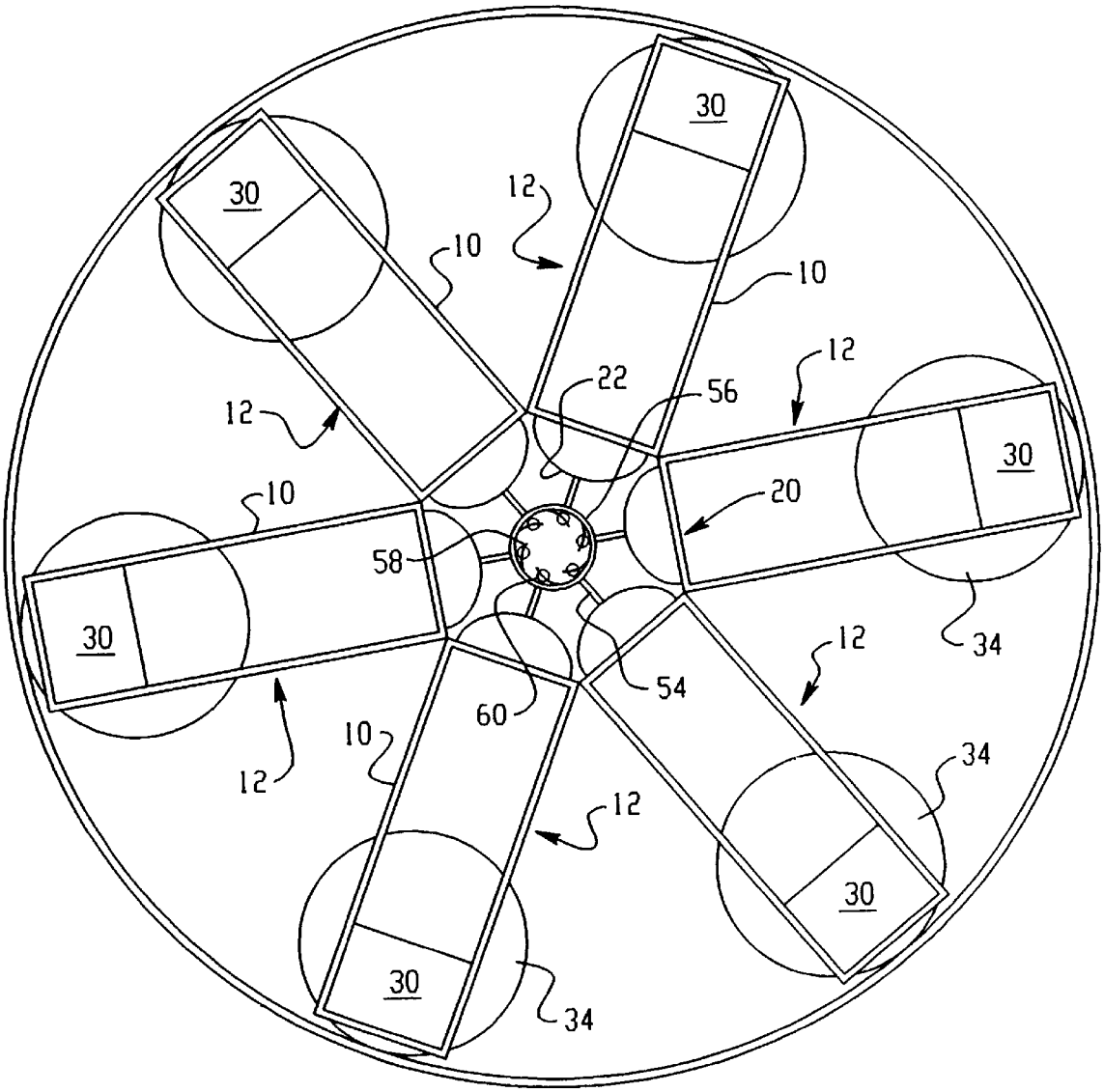

A frame 10, such as a frame of metal elements, molded plastic, or the like, holds a plurality of lighting modules 12 arranged in a wagon-wheel pattern. A cosmetic cover 14 extends over an upper side of the frame. A mounting bracket 16 interconnects the frame 10 and the cover 14 with an articulated arm assembly.

Each of the modules 12 includes a reflector-type lamp assembly 20. More specifically, the reflector type lamp assembly includes a reflector 22, preferably a ellipsoidal reflector, in which a tungsten halide lamp 24 is mounted. Preferably, the lamp is mounted with its filament 26 at a focal point of the ellipsoidal reflector. Preferably, the lamp bulb has a dichroic coating which reflects infrared spectrum light back into the lamp towards the filament, but allows light from the visible spectrum to pass.

A lamp and reflector combination has a tendency to project an image of the filament. In the preferred embodiment, a means is provided for inhibiting the projection of the filament image from detracting from the illumination at the surgical site. First, the filament 26 is vertically mounted within the light bulb (horizontal in FIG. 1) such that the filament is parallel to the direction along which the light is projected by the reflector. This orientation of the filament reduces the projected image to an end view of the filament, rather than the side view which would be projected with a conventional horizontal filament lamp. Second, the reflector 22 is faceted. More specifically, the reflector is fluted around its periphery, with each flute being divided into a series of facets. Each facet is aimed to reflect the light slightly off from the central axis of the reflector, preferably criss-crossing the central axis. The multiplicity of facets each reflecting the light in a slightly different direction but all generally parallel to the axis breaks up the image of the filament, prevents hot spots, extends the depth of field, and improves illumination uniformity at the target.

In the preferred embodiment, each of the lamps is 35–50 Watts, with each of the reflectors 22 being 50–75 mm in diameter. The reflectors are preferably fabricated of plastic material with an aluminized or other highly reflective coating. Optionally, a dichroic coating can be applied to the reflector to limit the content of infrared radiation in the reflected light. The reflected light is directed radially outward along the spokes to a secondary reflector 30. The secondary reflector includes a planar, dichroic mirror which reflects the visible spectrum and passes the infrared spectrum. In this manner, infrared components which would heat the surgical site are transmitted to another direction. The infrared light may be reflected up towards the ceiling, against the housing 14 and converted into heat which is dispersed into the room, or the like. Alternately, a mirror can be placed in back of the dichroic mirror to focus the infrared light back on the filament 26 of the lamp.

The mirror 30 is positioned relative to the reflector-type and lamp assembly 20 such that the light is reflected in a beam which crosses a central axis of the light head at a horizontal plane about 1.5 m below the light head to define a circular illumination zone. In the illustrated embodiment, six such modules are positioned around the light head. In this manner, six fully redundant beams of visible light are directed to cross the central axis at the same horizontal plane. During surgery, when the surgeon leans in towards the surgical site and blocks one of the beams, the other five continue to illuminate the site. Similarly, motion of the surgeon's hands and instruments only shield different parts of redundant beams such that significant shadows are not cast into the surgical site.

A closure 32 extends across a lower side of the housing 14. The closure includes a series of optically transmissive regions 34, preferably circles or ovals each of sufficient diameter for one of the beams to pass undisturbed therethrough. Various embodiments of the light transmissive panels 34 are contemplated including clear plastic or tempered glass disks, disks with a dichroic or other spectrum selective filter material, diffusers for diffusing and softening the light beam, a refractor disk, and the like. As another alternative, the entire closure 32 may be constructed of a single light transmissive element. Regions through which the light beams do not pass may be blackened or colored for cosmetic purposes.

A control handle 40 is rotatably mounted to the frame structure 10 through an aperture in the center of the cover 32. The handle 40 is mechanically connected with a switch 42, preferably a multi-position switch, which causes a power supply 44 to turn the lamp modules 20 ON and OFF. When a multi-position switch is employed, the handle can be moved, e.g., up and down, to different positions to turn on different numbers of the modules for different intensities. Although the power supply 44 can also adjust the voltage to the lamps to lower the intensity, dimming the lights tends to increase the percentage of infrared content in the light. When the power supply starts supplying power to the lamps, the power supply initially applies a lower voltage that is ramped up to the operating voltage.

The handle 40 is also connected to a mechanical linkage 50 for adjusting the size of the spot. In the preferred embodiment, the mechanical linkage includes a hinge 52 such that each of the lamp and reflector modules 20 is pivotally mounted. In the illustrated embodiment, the other end of each lamp and reflector modules is connected by a linkage rod 54. All of the linkage rods are connected to a common rotary element such that they move inward towards the central axis or outward from the central axis concurrently. In the preferred embodiment, the handle 40 includes or is connected with a disk 56 having spiralling cam surfaces 58 therein. Each of the links 54 is connected to a pin 60 which rides in one of the cam surfaces. In this manner, as the handle is rotated, the cam surfaces cam the pins 60 inward and outward, pulling all the rods inward in unison or pushing them outward in unison. Preferably, each of the pins rides in a different, but like cam surface. This enables the cam surfaces to be shaped such that the degree of adjustment in spot size can be more precise or less precise at some diameters or distances in the depth of field of the spot than others.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A surgical light comprising:

a frame;

a cover mounted on the frame; and, a plurality of independent light modules mounted in the frame, each of the plurality of independent light modules including:

a reflector;

a lamp mounted in the reflector such that the lamp and reflector project a beam of light therefrom; and, a dichroic mirror disposed adjacent a periphery of the frame for reflecting visible spectrum components of the beam of light toward a common illumination zone.

2. The surgical light as set forth in claim 1 wherein the reflector is fluted.

3. The surgical light as set forth in claim 2 wherein the reflector is faceted.

4. The surgical light as set forth in claim 1 wherein the lamp has a filament mounted parallel to the beam of light.

5. The surgical light as set forth in claim 1 wherein the dichroic mirror is planar and arranged such that the visible spectrum component is reflected towards the illumination zone and infrared light passes therethrough.

6. The surgical light as set forth in claim 1 wherein at least one of the reflector and the lamp have a dichroic coating.

7. The surgical light as set forth in claim 1 further including:

a disk connected with a lower portion of the frame, the disk being light transmissive at least in regions adjacent each of the dichroic mirrors such that the beams of the visible spectrum light pass therethrough.

8. The surgical light as set forth in claim 1 further including a means for adjusting a diameter of the illumination zone.

9. The surgical light as set forth in claim 1 wherein each of the reflectors is pivotally mounted to the frame and further including:

a handle movably,mounted to the frame;

a mechanical linkage interconnecting the handle and the reflectors such that movement of the handle tips each of the reflectors a corresponding amount adjusting a diameter of the illumination zone.

10. The surgical light as set forth in claim 9 wherein the mechanical linkage includes:

a rotatably mounted member having a plurality of cam surfaces therein;

a plurality of cam followers in the cam surfaces;

a rod connecting each of the reflectors with one of the cam follows;

the handle being connected with the member for rotating it such that rotation of the member cams the followers radially inward and outward, causing the pivoting of the reflectors.

11. The surgical light as set forth in claim 9 wherein the handle is also connected with a switch for controlling a control circuit to turn the lamps ON and OFF, the control circuit including a circuit for ramping up the lamps each time they are turned on to prolong bulb life.

12. The surgical light according to claim 1 wherein each of said plurality of independent light modules is an elongated module, the plurality of independent light modules being mounted radially in a wagon-wheel pattern with light being discharged adjacent a periphery of said cover.

13. A method of illuminating a surgical site, the method comprising:

mounting a plurality of lighting modules radially outward from a common central axis;

within each module, illuminating a lamp to generate light and reflecting the light from a reflector to project a beam of light directed radially outward from the central axis;

using a dichroic mirror, reflecting the beams of light projected from the plurality of lighting modules generally parallel to the central axis, but toward the central axis such that the plurality of beams of light all cross the central axis adjacent a common plane to define a zone of illumination.

14. The method as set forth in claim 13 further including in the reflecting step, reflecting light in a visible spectrum toward the intersection of the common axis and the common plane and passing light in the infrared spectrum such that infrared light is diverted from reaching the illumination zone.

15. The method set forth in claim 13 further including:

each time power is supplied to the lamps, ramping up the power to prolong lamp life.

16. The method as set forth in claim 13 further including the step of tipping the reflectors to adjust a diameter of the illumination zone.

17. A method of illuminating a surgical site, the method comprising:

mounting a plurality of lighting modules radially outward from a common central axis;

within each module, illuminating a lamp to generate light and reflecting the light from a reflector to create beams of light directed radially outward from the central axis;

deflecting the beams of light generally parallel to the central axis, but toward the central axis such that the plurality of beams of light all cross the central axis adjacent a common plane to define a zone of illumination; and, tipping the reflectors to adjust a diameter of the illumination zone.

18. The method as set forth in claim 17 further including in the reflecting step, reflecting light in a visible spectrum toward the intersection of the common axis and the common plane and passing light in the infrared spectrum such that infrared light is diverted from reaching the illumination zone.

19. The method set forth in claim 17 further including the step of, each time power is supplied to the lamps, ramping up the power to prolong lamp life.

20. A surgical light comprising:

a frame;

a cover mounted on the frame; and, a plurality of independent light modules mounted in the frame, each of the plurality of independent modules including: a reflector pivotally mounted to the frame; a lamp mounted in the reflector such that the lamp and reflector project a beam of light therefrom; and, a dichroic mirror disposed adjacent a periphery of the frame for reflecting visible spectrum components of the beam of light toward a common illumination zone;

a handle movably mounted to the frame; and, a mechanical linkage interconnecting the handle and the reflectors such that movement of the handle moves each of the reflectors a corresponding amount thereby adjusting a diameter of the illumination zone.

21. The surgical light as set forth in claim 20 wherein the mechanical linkage includes:

a rotatably mounted member having a plurality of cam surfaces therein;

a plurality of cam followers in the cam surfaces;

a rod connecting each of the reflectors with one of the cam follows;

the handle being connected with the member for rotating it such that rotation of the member cams the followers radially inward and outward, causing the pivoting of the reflectors.

22. The surgical light as set forth in claim 20 wherein the handle is also connected with a switch for controlling a control circuit to turn the lamps ON and OFF, the control circuit including a circuit for ramping up the lamps each time they are turned on to prolong bulb life.

* * * * *